US009222633B2

(12) United States Patent
Inskeep

(10) Patent No.: US 9,222,633 B2
(45) Date of Patent: Dec. 29, 2015

(54) MULTI-AXIS TILTING LIGHT STAND WITH REMOVABLE LIGHT

(71) Applicant: Mathew Inskeep, Boca Raton, FL (US)

(72) Inventor: Mathew Inskeep, Boca Raton, FL (US)

( * ) Notice: Subject to any disclaimer, the term of this patent is extended or adjusted under 35 U.S.C. 154(b) by 49 days.

(21) Appl. No.: 14/090,694

(22) Filed: Nov. 26, 2013

(65) Prior Publication Data

US 2014/0301066 A1 Oct. 9, 2014

Related U.S. Application Data

(60) Provisional application No. 61/810,070, filed on Apr. 9, 2013.

(51) Int. Cl.

| | |
|---|---|
| ***F21V 21/06*** | (2006.01) |
| ***F21S 9/02*** | (2006.01) |
| *F21V 21/22* | (2006.01) |
| *F21V 21/30* | (2006.01) |
| *F21V 21/40* | (2006.01) |
| *F21W 131/10* | (2006.01) |

(52) U.S. Cl.

CPC .. *F21S 9/02* (2013.01); *F21V 21/06* (2013.01); *F21V 21/22* (2013.01); *F21V 21/30* (2013.01); *F21V 21/40* (2013.01); *F21W 2131/10* (2013.01)

(58) Field of Classification Search

CPC ..... F21L 4/00; F21L 4/04; F21S 9/02; F21W 2131/10; F21V 21/06; F21V 21/22; F21V 21/30; F21V 21/40

See application file for complete search history.

(56) References Cited

U.S. PATENT DOCUMENTS

| | | | | |
|---|---|---|---|---|
| 6,265,969 | B1 | 7/2001 | Shih | |
| 7,195,377 | B2 | 3/2007 | Tsai | |
| 7,224,271 | B2 | 5/2007 | Wang | |
| 7,484,858 | B2 | 2/2009 | Deighton et al. | |
| D612,084 | S | 3/2010 | Hillard | |
| 8,087,797 | B2 * | 1/2012 | Pelletier et al. | 362/205 |
| 8,201,979 | B2 | 6/2012 | Deighton et al. | |

(Continued)

FOREIGN PATENT DOCUMENTS

| | | |
|---|---|---|
| KR | 10-2004-0109118 | 11/2005 |
| WO | WO-02/44503 A1 | 6/2002 |

(Continued)

OTHER PUBLICATIONS

International Search Report issued in International Patent Application No. PCT/US2014/038470 dated Apr. 3, 2015.

(Continued)

*Primary Examiner* — Mary Ellen Bowman

(57) ABSTRACT

A portable light includes a light stand having a longitudinal axis and a light assembly section attached to the light stand. The light assembly section is adapted to be connected to a power source and includes a support having a support axis being rotatable and linearly displaceable relative to the longitudinal axis of the light stand; a light panel holder tiltably attached to the support such that the light panel holder is tiltable relative to the support axis; and a light panel removably connected to the light panel holder and tiltable relative to the support axis. The light panel contains a rechargeable battery and a light selectively electrically connectable to at least one of the power source and the rechargeable battery when the light panel is connected with the light panel holder and being powered by the rechargeable battery when the light panel is removed from the light panel holder.

19 Claims, 19 Drawing Sheets

(56) References Cited

U.S. PATENT DOCUMENTS

| | | | | |
|---|---|---|---|---|
| 2008/0225518 | A1* | 9/2008 | Devaney et al. | 362/197 |
| 2009/0103290 | A1 | 4/2009 | Liu | |
| 2010/0039801 | A1 | 2/2010 | Pelletier et al. | |
| 2011/0012518 | A1 | 1/2011 | Tarter | |
| 2012/0057331 | A1 | 3/2012 | Janice | |
| 2012/0261530 | A1 | 10/2012 | Deighton et al. | |
| 2013/0128565 | A1 | 5/2013 | Cugini et al. | |
| 2013/0265766 | A1 | 10/2013 | Choksi et al. | |

FOREIGN PATENT DOCUMENTS

| | | | |
|---|---|---|---|
| WO | WO-2009/108455 | A2 | 9/2009 |
| WO | WO-2009/111184 | A3 | 9/2009 |

OTHER PUBLICATIONS

Written Opinion issued in International Patent Application No. PCT/US2014/038470 dated Apr. 3, 2015.

* cited by examiner

MULTI-AXIS TILTING LIGHT STAND WITH REMOVABLE LIGHT

CROSS-REFERENCE TO RELATED APPLICATIONS

This application claims priority to U.S. Provisional Application Ser. No. 61/810,070, filed on Apr. 9, 2013, the disclosure of which is incorporated herein by reference in its entirety.

TECHNICAL FIELD

The present invention relates generally to a light stand, and, in particular, to a multi-axis tilting light stand with a charging circuit and removable lights.

BACKGROUND

Light stands are well known to those of ordinary skill in the art. Light stands may be used in various environments such as residential, commercial, or industrial environments in order to illuminate work or recreational areas.

However, conventional light stands fail to provide flexibility and modularity to address different and changing light requirements. Accordingly, there remains a need for a light stand having multiple axes for tilting and with removable lights.

SUMMARY

According to an embodiment, a portable light comprises a light stand having a longitudinal axis; and a light assembly section attached to the light stand, wherein the light assembly section is adapted to be connected to a power source and comprises a support having a support axis being rotatable about the longitudinal axis of the light stand and being linearly displaceable along the longitudinal axis of the light stand; at least one light panel holder tiltably attached to the support, wherein the at least one light panel holder is tiltable between a stow position aligned essentially parallel to the support axis and a tilt position at an angle to the support axis; and a light panel removably connected to the light panel holder and tiltable relative to the support axis along with the light panel holder, the light panel containing a rechargeable battery and a light selectively electrically connectable to at least one of the power source and the rechargeable battery when the light panel is connected with the light panel holder and being powered by the rechargeable battery when the light panel is removed from the light panel holder.

According to an embodiment, a portable light comprises a telescoping section having a lower telescoping member and an upper telescoping member, and a light assembly section comprising a tilting hinge disposed on the upper telescoping member; at least one light panel holder hingedly attached to the light panel hinge bracket, the at least one light panel holder having a back portion and a tray portion, the back portion having a tilt lock portion extending therefrom; a center lock member disposed on the light assembly section and movable along an axis of the light assembly section between an unlocked position and a locked position; wherein each of the at least one light panel holder is configured to tilt relative to the axis of the light assembly section; wherein the light assembly section is configured to tilt about an axis of the tilting hinge.

According to an embodiment, a light stand comprises a telescoping section having a lower telescoping member and an upper telescoping member, and a light assembly section disposed on the upper telescoping member, wherein the light assembly section comprises an upper post extending upwardly therethrough; a hinge bracket; at least one light panel holder hingedly attached to the hinge bracket, the at least one light panel holder having a back portion and a bottom tray portion, the back portion having a tilt lock portion extending therefrom; a center lock member disposed on the upper post and movable along the upper post between an unlocked position and a locked position; wherein the at least one light panel holder is tiltable between a stow position and a tilt position relative to the hinge bracket; wherein in the locked position, the center lock member captures the tilt lock portion to fix the at least one light panel holder in the stow position.

According to another embodiment, a light stand comprises a telescoping section having a lower telescoping member and an upper telescoping member. The light assembly section comprises a tilting hinge disposed on the upper telescoping member; an upper post extending upwardly from the tilting hinge; a light panel hinge bracket disposed on the tilting hinge; at least one light panel holder hingedly attached to the light panel hinge bracket, the at least one light panel holder having a back portion and a bottom tray portion, the back portion having a tilt lock portion extending therefrom; a center lock member disposed on the upper post and movable along the upper post between an unlocked position and a locked position; wherein each of the at least one light panel holder is configured to tilt relative to the light panel hinge bracket; wherein the light assembly section is configured to tilt about an axis of the tilting hinge Further aspects, objectives, and advantages, as well as the structure and function of embodiments, will become apparent from a consideration of the description, drawings, and examples.

BRIEF DESCRIPTION OF THE DRAWINGS

The features and advantages of the invention will be apparent from the following drawings wherein like reference numbers generally indicate identical, functionally similar, and/or structurally similar elements.

DETAILED DESCRIPTION

Embodiments of the invention are discussed in detail below. In describing embodiments, specific terminology is employed for the sake of clarity. However, the invention is not intended to be limited to the specific terminology so selected. A person skilled in the relevant art will recognize that other equivalent parts can be employed and other methods developed without departing from the spirit and scope of the invention.

Figure 1:
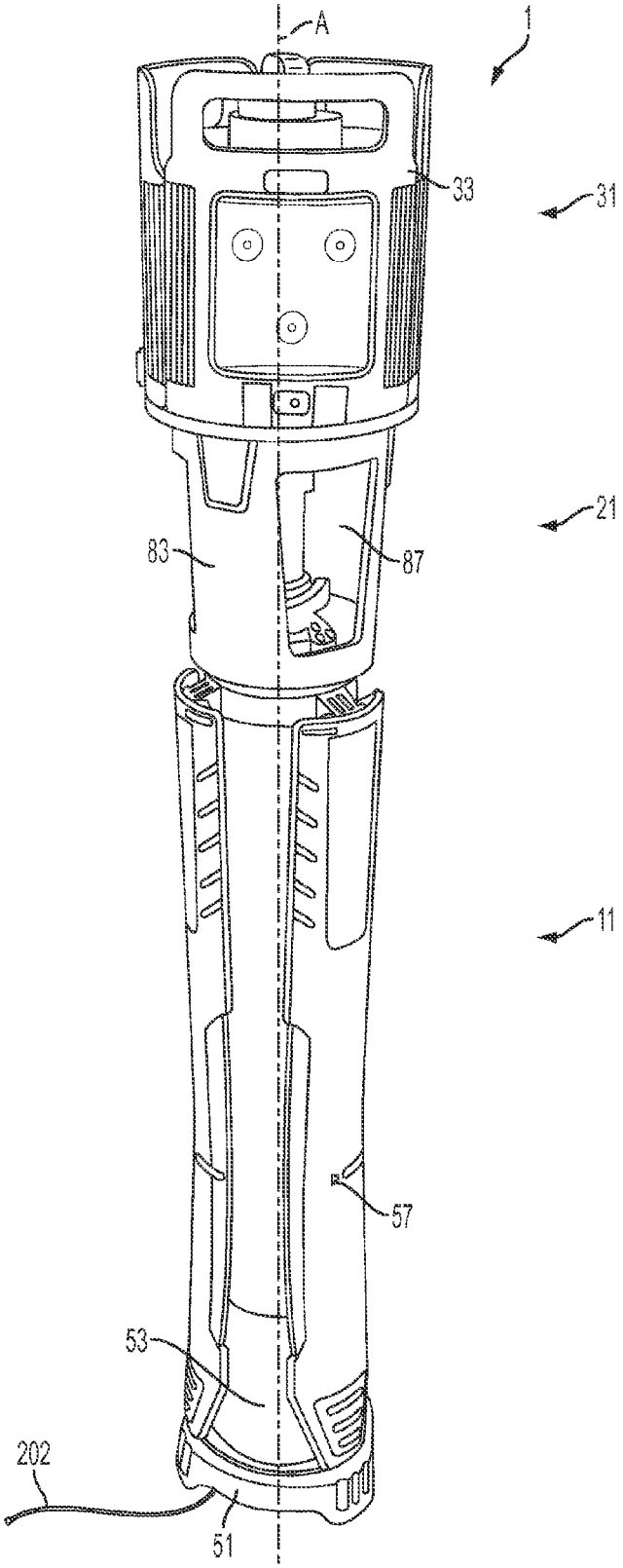
FIG. 1 is a perspective view of an embodiment of a light stand.
Figure 2:
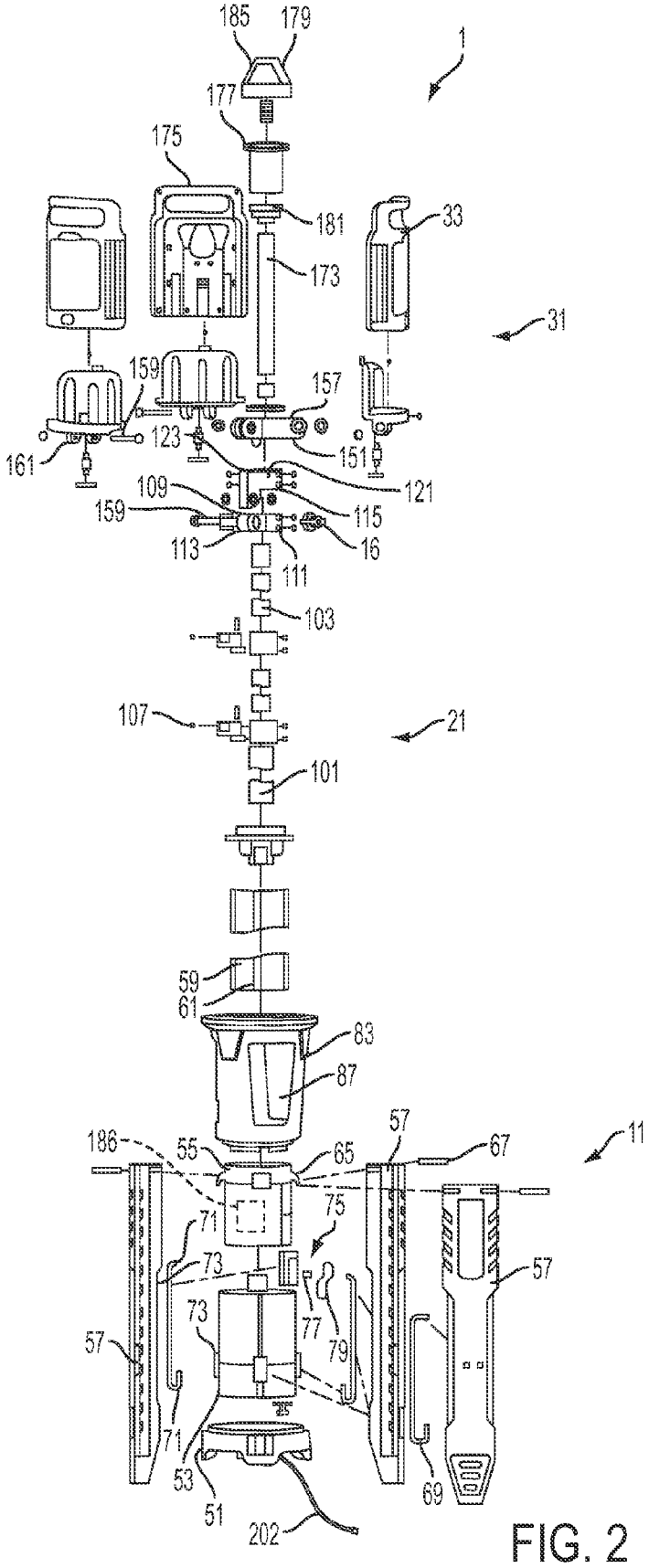
FIG. 2 is an exploded assembly view of the light stand of FIG. 1.
Figure 3:
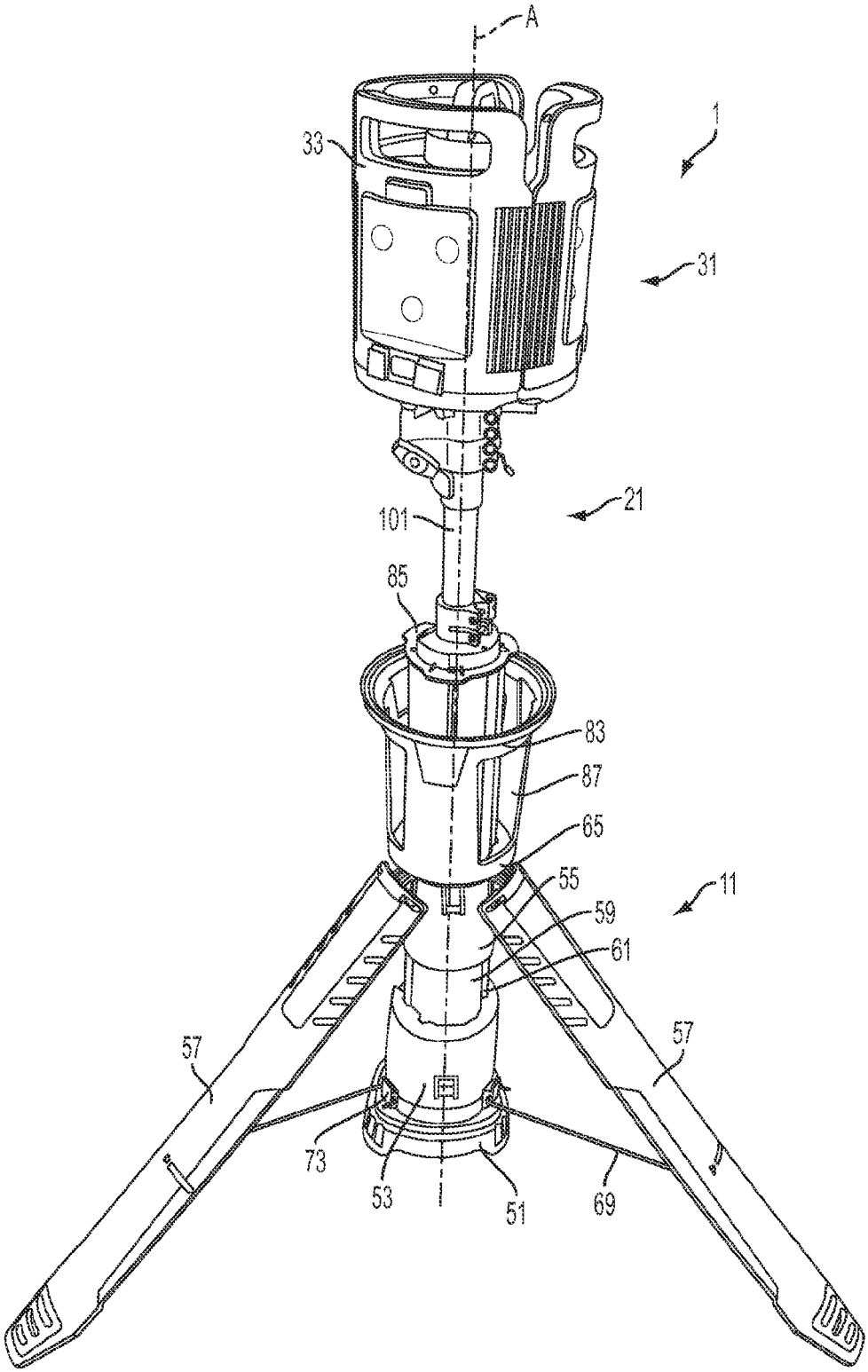
FIG. 3 is a perspective view of the light stand of FIG. 1.
Figure 7:
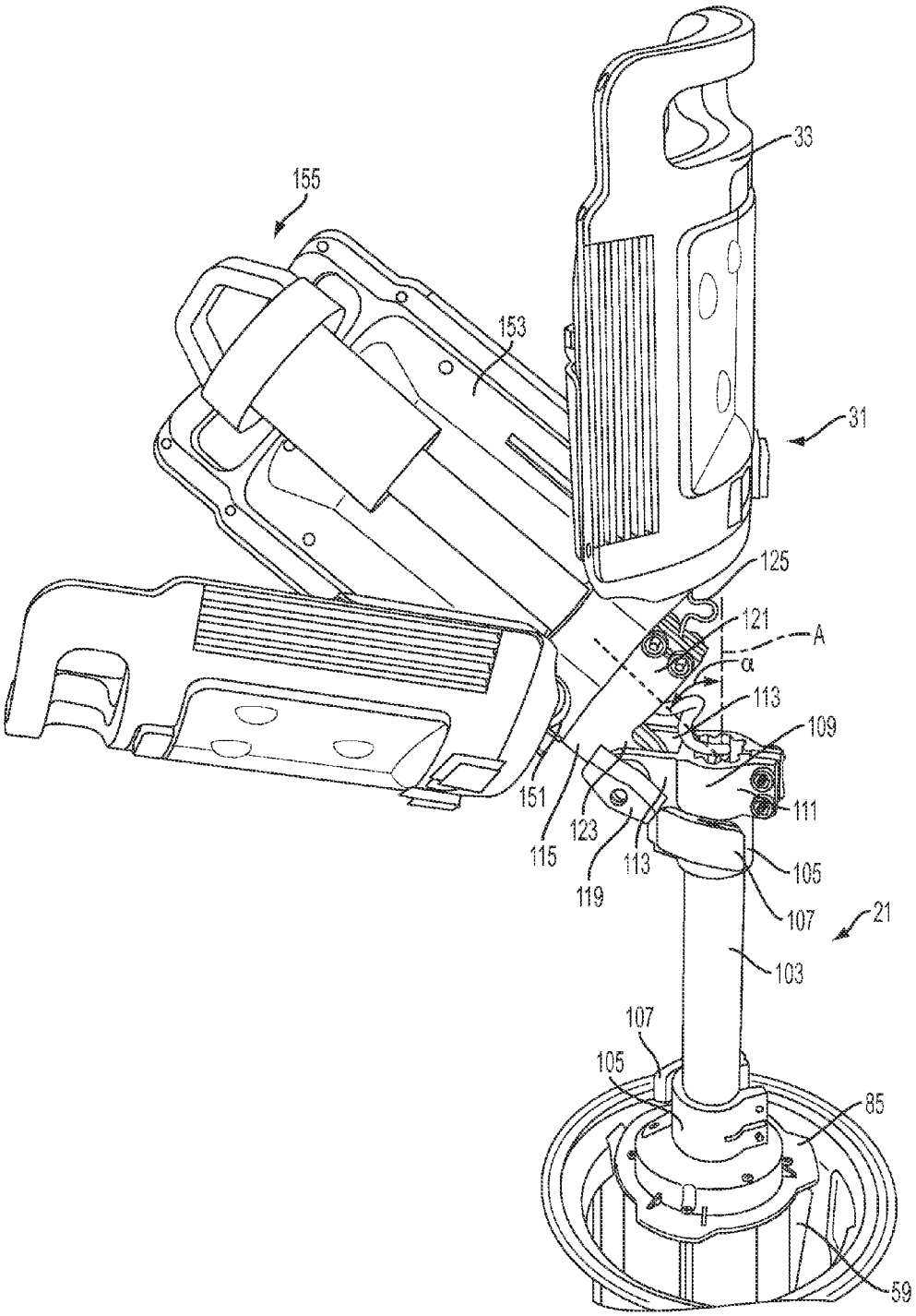
FIG. 7 is a side view of a light assembly section.

Referring generally to FIGS. 1-14, embodiments of a light stand are described. Referring now to FIGS. 1 and 2, the light stand 1 may generally comprise a stand section 11, a telescoping section 21, and a light assembly section 31 having at least one light panel 33. In the position illustrated at FIG. 1, for example, the light stand 1 and each of the stand section 11, the telescoping section 21, and the light assembly section 31 has a substantially common longitudinal axis A. As illustrated at FIG. 7, for example, the support axis of the light assembly section 31 may be at an angle from the longitudinal axis A by the angle $\alpha$. As shown at FIGS. 1 and 3, for example, the light stand 1 is movable between a stow-position, at FIG. 1, and a use-position, at FIG. 3. In the stow-position, the light stand 1 may generally form a cylindrical shape in order to store and transport the light stand 1. In the use-position, the light stand 1 may be moved to various positions or configurations, as required for a particular lighting requirement. For example, the light stand 1 may be moved from a stow-position, to a variety of different use-positions, as described in more detail below.

Referring now to FIG. 2, the stand section 11 may comprise a base 51, a lower holder 53, an upper lock collar 55, a plurality of legs 57, and a center post 59. According to an embodiment, the lower holder 53 may be fixedly attached directly on the base 51. The center post 59 may be received into or through the lower holder 53. According to different embodiments, the center post 59 may be either in direct contact with the base 51 or separated from the base 51 with a bottom section (not shown) of the lower holder 53. The relative positions of the base 51, lower holder 53, and center post 59 may be generally fixed so as to provide a stable stand for the light stand 1.

According to an embodiment, an upper end of the center post 59 may be slidably received in the upper lock collar 55. For example, in some embodiments, the center post 59 may be provided with a ridge 61 protruding away from the outer surface of the center post 59 extending along a longitudinal axis of the center post 59, which is also the support axis by the angle $\alpha$ from the longitudinal axis A. The upper lock collar 55 may be similarly provided with a mating groove (not shown) in an inner surface of the upper lock collar 55. In such an embodiment, the upper lock collar 55 may slide upwardly and downwardly along the longitudinal axis of the center post 59 such that the mating ridge 61 and groove prevent relative rotational movement of the upper lock collar 55 and center post 59. It is also foreseen that the center post 59 may be provided with a groove and the upper lock collar 55 may be provided with a mating ridge, and that either only one or any plurality of mating ridges and grooves may be provided.

The plurality of legs 57 may be hingedly attached to the upper lock collar 55. For example, the upper lock collar 55 may be provided with a hinge 65 for each of the plurality of legs 57. As illustrated at FIG. 2, each of the plurality of legs 57 may be provided with a hinge pin 67 in order to hingedly attach each of the plurality of legs 57 to each of the hinges 65. It is foreseen that other types of hinges may be utilized with the present embodiment, such as, for example, a pivot hinge, a barrel hinge, a butt hinge, or other types of hinges as known to one of ordinary skill in the art. Alternatively, the legs may be integrally formed with the upper lock collar with a relatively thin bending section therebetween provided for hingedly moving the legs relative to the upper lock collar.

Each of the plurality of legs 57 further includes a leg rod 69 hingedly attached between each leg 57 and the lower holder 53. For example, the leg rod 69 may include a hinging portion 71 at each end that inserts into leg rod receivers 73 of the leg 57 and lower holder 53, respectively, allowing the leg rod 69 to hinge relative to both the leg 57 and lower holder 53. The leg rod 69 may be attached at approximately a middle portion of the leg 57 and approximately at a lower portion of the lower holder 53. However, the positions of attachment to the leg 57 and lower holder 53 may be adjusted depending on the leg position desired when the light stand 1 is placed in a use-position.

In the stow-position, the leg rod 69 is approximately parallel to the longitudinal axis of the light stand 1 allowing the stand section 11 to be in an approximately cylindrical shape. As illustrated at FIG. 3, when the light stand 1 is moved to a first use-position, the upper lock collar 55 slides along the center post 59 to a position relatively closer to the lower holder 53. Accordingly, the leg rods 69 hinge with respect to the legs 57 and the lower holder 53. According to an embodiment, the leg rod 69 provides support to fix the legs 57 at a desired angle relative to the longitudinal axis of the center post 59. For example, the leg rod 69 provides structural support to the legs 57 to support a large weight of, for example, the light assembly section 31. For example, as illustrated at FIG. 3, the light stand may be configured to a first use-position with the legs 57 extended from the stand.

As shown in the figures, it is foreseen that three legs 57 may be provided to form a tripod-type stand. It is also foreseen that more than three legs 57 may be provided, such as, for example, four legs, five legs, or more.

According to an embodiment, the stand section 11 may be further provided with a detent or stand lock 75 provided at the upper lock collar 55. The stand lock 75 may be provided with a stand release shaft 77 provided through the upper lock collar 55 and into the center post 59. According to an embodiment, for example, the center post 59 may be provided with a plurality of holes or grooves (not shown) for receiving the stand release shaft 77 therein, thus fixing the position of the upper lock collar 55 relative to the center post 59 in various positions between the stow-position and the use-position. Alternatively, the center post 59 may be provided with one hole to fix the upper lock collar 55 in the stow-position and another hole to fix the upper lock collar 55 in the use-position. The stand release shaft 77 may be actuated into or out of the center post 59 with a stand release shaft lever 79. According to an embodiment, a spring may be provided in order to bias the stand release shaft 77 inwardly so that a user is required to use the stand release shaft lever 79 to move the stand release shaft 77 outwardly in order to move the light stand between the stow-position and the use position.

According to an embodiment, a cover collar 83 may be provided on the upper lock collar 55 in order to cover at least a portion of the telescoping section 21. For example, the cover collar 83 may, for example, protect a user from pinch hazards resulting from at least the covered portion of the telescoping section 21. Additionally, the cover collar 83 may cover the control panel 85 provided at a top end of the center post 59 when the light stand 1 is in the stow-position. According to an embodiment, the cover collar 83 may directly contact and support the light assembly section 31 when in the stow-position. Further, the cover collar 83 may have at least one opening 87 in order to provide access to the telescoping section 21 or other controls when the light stand 1 is in the stow-position.

Figure 4:
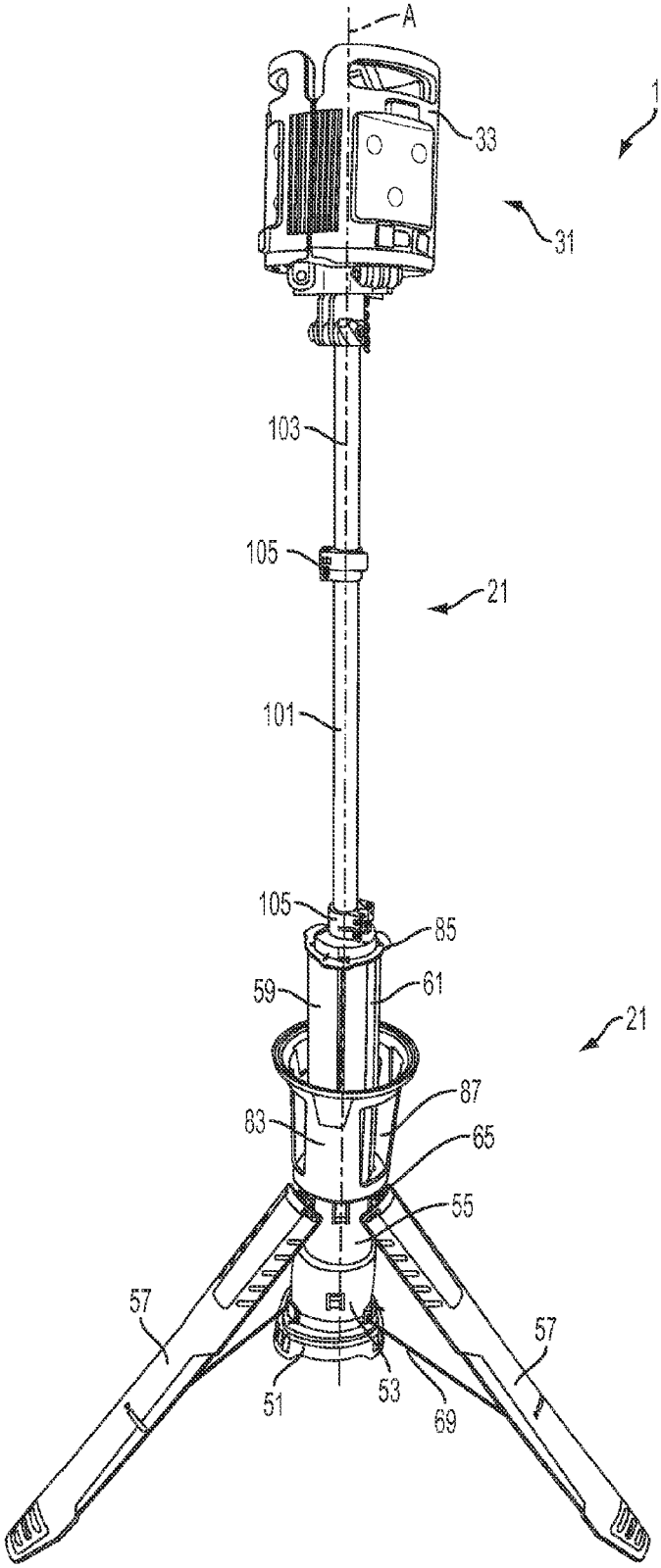
FIG. 4 is a perspective view of the light stand of FIG. 1.
Figure 5:
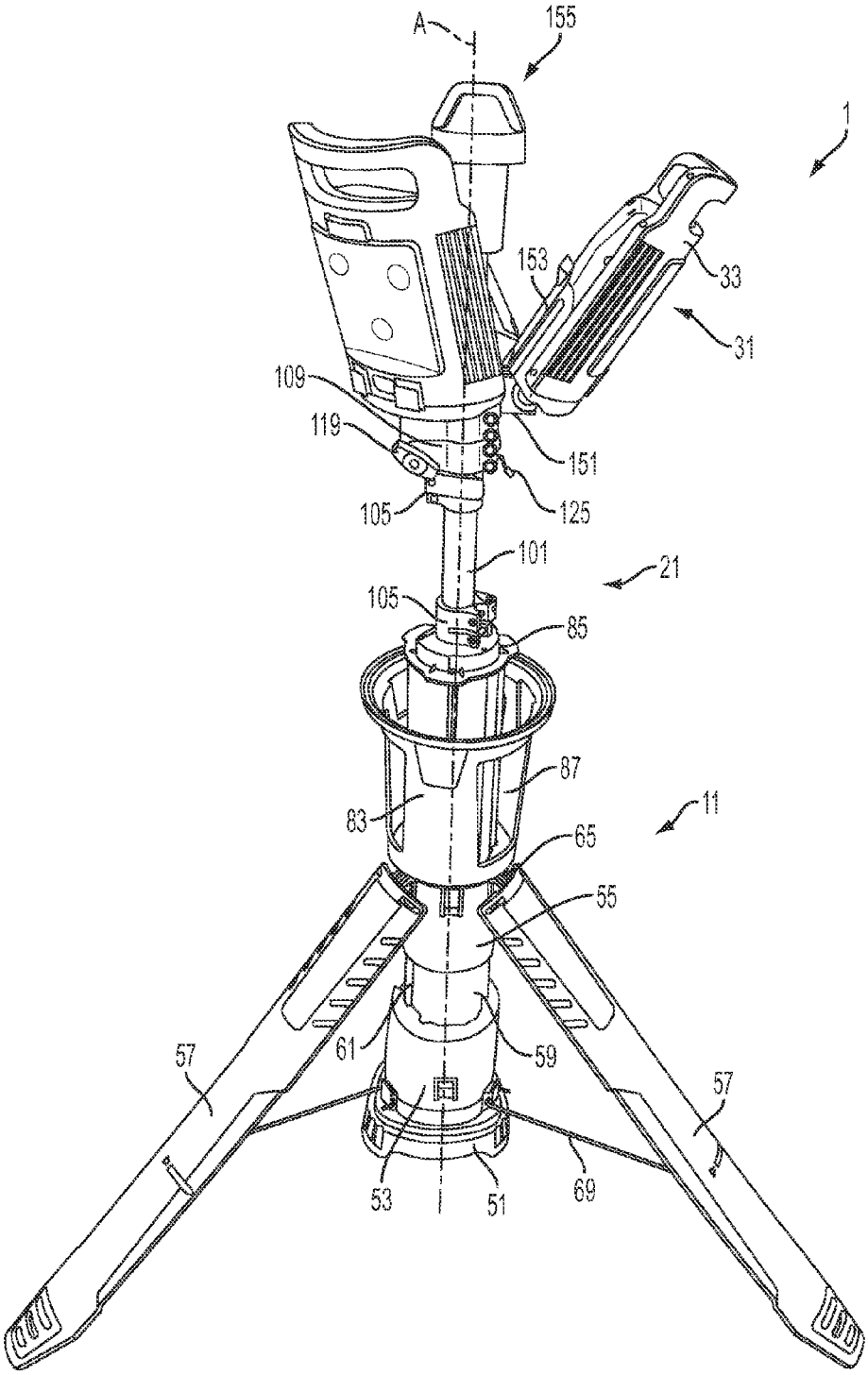
FIG. 5 is a perspective view of the light stand of FIG. 1.
Figure 6:
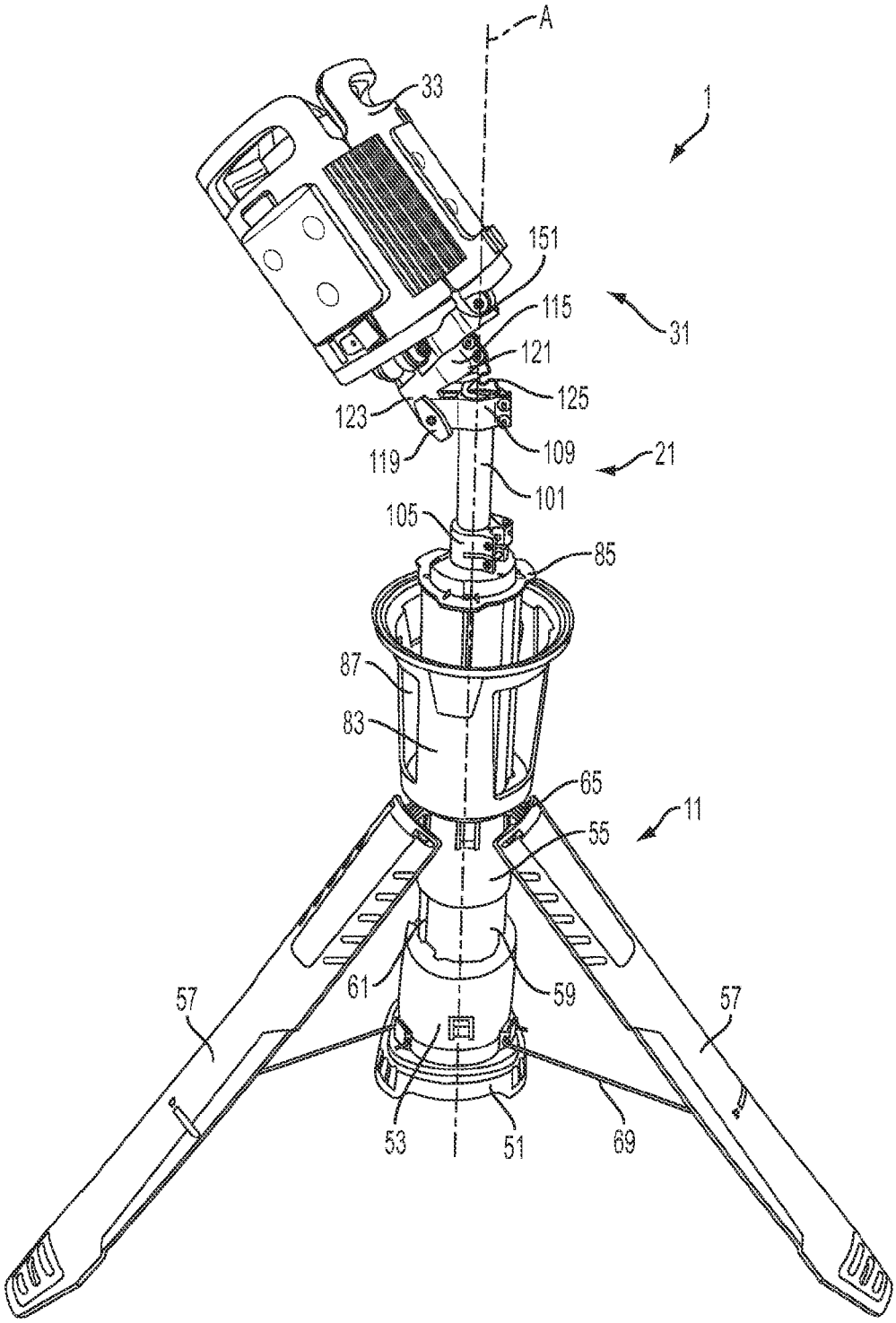
FIG. 6 is a perspective view of the light stand of FIG. 1.

According to an embodiment, in order to adjust the height of the light assembly section 31, the telescoping section 21 is provided. Referring now to FIG. 4, the telescoping section 21 may generally comprise the center post 59, a first telescoping shaft 101, and a second telescoping shaft 103. As explained above, the center post 59 is positioned relative to the upper lock collar 55 and, according to various embodiments, may be fixed at a position relative to the upper lock collar 55 using the stand lock 75. The relative movement may be a telescoping movement of the center post 59 relative to the various portions of the stand section 11. The first telescoping shaft 101 and/or second telescoping shaft 103 may additionally be provided for further height extension of the light assembly section 31. According to an embodiment, the first and/or second telescoping shafts 101 and 103 may be considered an upper telescoping member, and the center post 59 may be considered a lower telescoping member. Alternatively, the first telescoping shaft 101 may be considered the lower telescoping member and the second telescoping shaft 103 may be considered the upper telescoping member.

According to an embodiment, the first telescoping shaft 101 may be slidably received into the center post 59. Accordingly, the first telescoping shaft 101 may have a smaller outer diameter than that of the center post 59. For example, the first telescoping shaft 101 may be concentrically centered within the center post 59 and slidable along the longitudinal axis of the center post 59. A telescoping shaft lock collar 105 may be provided at the top end of the upper lock collar 55 or on the control panel 85. For example, the control panel 85 may be fixed to and cover the top end of the upper lock collar 55. The telescoping shaft lock collar 105 may receive the first telescoping shaft 101 therethrough. According to an embodiment, the telescoping shaft lock collar 105 may be, for example, a buckle ring. The telescoping shaft lock collar 105 may be configured to have a variable inner diameter. For example, in a first position, the telescoping shaft lock collar 105 may allow the first telescoping shaft 101 to move relative to the center post 59 in both a telescoping and rotational manner and, in a second position, the telescoping shaft lock collar 105 may be tightened around the first telescoping shaft 101 to prevent movement in both a telescoping and rotational manner, by increased friction, of the first telescoping shaft 101 relative to the center post 59. The telescoping shaft lock collar 105 may be provided with a latch 107 in order to move the telescoping shaft lock collar 105 between the first position and the second position. It is foreseen that other devices may be utilized to fix the first telescoping shaft 101 in a position relative to the center post 59 such as, for example, a detent, a shaft inserted through the first telescoping shaft 101 and the center post 59, and other means as known to one of ordinary skill in the art.

According to an embodiment, the second telescoping shaft 103 may optionally be provided. The second telescoping shaft 103 may have a smaller outer diameter than that of the telescoping shaft 101. For example, the second telescoping shaft 103 may be concentrically centered within the first telescoping shaft 103 and slidable along the longitudinal axis of the first telescoping shaft 103. Similar to the above, an additional telescoping shaft lock collar 105 may be provided at the top end of the first telescoping shaft 101. The additional telescoping shaft lock collar 105 may allow the second telescoping shaft 103 to move relative to the first telescoping shaft 101 and in a second position, the telescoping shaft lock collar 105 may be tightened around the second telescoping shaft 103 to prevent movement, by increased friction, of the second telescoping shaft 103 relative to the first telescoping shaft 101. As explained above, it is foreseen that other devices may be utilized to fix the second telescoping shaft 103 in a position relative to the first telescoping shaft 101. According to other embodiments, it is foreseen that any number of telescoping shafts may be similarly incorporated into the telescoping section 21 or, additionally, into the stand section 11 and/or light assembly section 31 of the light stand 1. For example, the light stand with the telescoping shafts extended may be considered a second use-position.

As described above, the inner receiving area of the center post 59, the outer surface and inner receiving area of the first telescoping shaft 101, and the outer surface of the second telescoping shaft 103 may be substantially circular so as to allow relative rotational movement thereof, when desired. However, according to other embodiments, the mating surfaces may be non-circular so as prevent relative rotational movement. For example, if relative rotational movement between the center post 59 and first telescoping shaft 101 is not desired, the inner receiving area of the center post 59 and the mating outer surface of the first telescoping shaft 101 may be square, or hexagonal, or another non-circular shape. Similarly, if relative rotational movement between the first telescoping shaft 101 and the second telescoping shaft 103 is not desired, the inner receiving area of the first telescoping shaft 101 and the mating outer surface of the second telescoping shaft 103 may be square, or hexagonal, or another non-circular shape. It is foreseen that only one or both or none of the center post 59/first telescoping shaft 101 or first telescoping shaft 101/second telescoping shaft 103 may allow rotational movement therebetween about the longitudinal axis A of the light stand 1. For example, the rotational movement of the telescoping shafts may be considered another use-position.

Referring now to FIGS. 2, 5, 6, and 7, the telescoping section 21 may further include a light assembly tilting hinge 109 at an upper end of the second telescoping shaft 103. As illustrated at FIG. 2, the light assembly tilting hinge 109 may comprise a collar 111 disposed around the upper end of the second telescoping shaft and having two arms 113 extending therefrom. A portion of an upper shaft bracket 115 may be received between the two arms 113 and hingedly attached therein with a shaft 117 extending therethrough. The shaft 117 may be a bolt with a bolt head disposed at one end and a knob 119 disposed at another end. The knob 119 may tighten the arms 113 together against the portion of the upper shaft bracket 115 in order to provide a friction fit and fix the tilting angle of the light assembly section 31 attached thereto. According to other embodiments, only one arm 113 may be provided so that the knob 119 may tighten the one arm 113 against the portion of the upper shaft bracket 115 in order to provide a friction fit and fix the tilting angle of the light assembly section 31 attached thereto.

The upper shaft bracket 115 may be provided with a transverse portion 121 and a longitudinal portion 123. As explained above, the longitudinal portion 123 of the upper shaft bracket 115 may be received between the arms 113 of the tilting hinge 109. According to a different embodiment, the length of the transverse portion 121 may extend approximately greater than or equal to half the radius of the light assembly section 31 in order to increase a tilting angle $\alpha$ relative to the longitudinal axis A, as illustrated at FIG. 7, for example. For example, the tilting angle $\alpha$ may range between 0° and 180° from the longitudinal axis of the light stand 1. According to other embodiments, the tilting angle $\alpha$ may range between 0° and 170° or 0° and 135°, for example. The knob 119 may tighten the arms 113 together against the longitudinal portion 123 of the upper shaft bracket 115 to fix the tilting angle α at any angle in the range of angles. For example, the tilted position may be considered a fourth use-position.

A hinge pin 125 may further be provided in order to fix the tilting angle at approximately 0°. For example, a first end of the hinge pin 125 may be hingedly connected to upper shaft bracket 115. When the tilting angle is at approximately 0°, the hinge pin 125 may be inserted into a receiving portion of the tilting hinge 109. Accordingly, in the stow-position, the light stand 1 may be transported without the light assembly section inadvertently tilting during transport.

Figure 8:
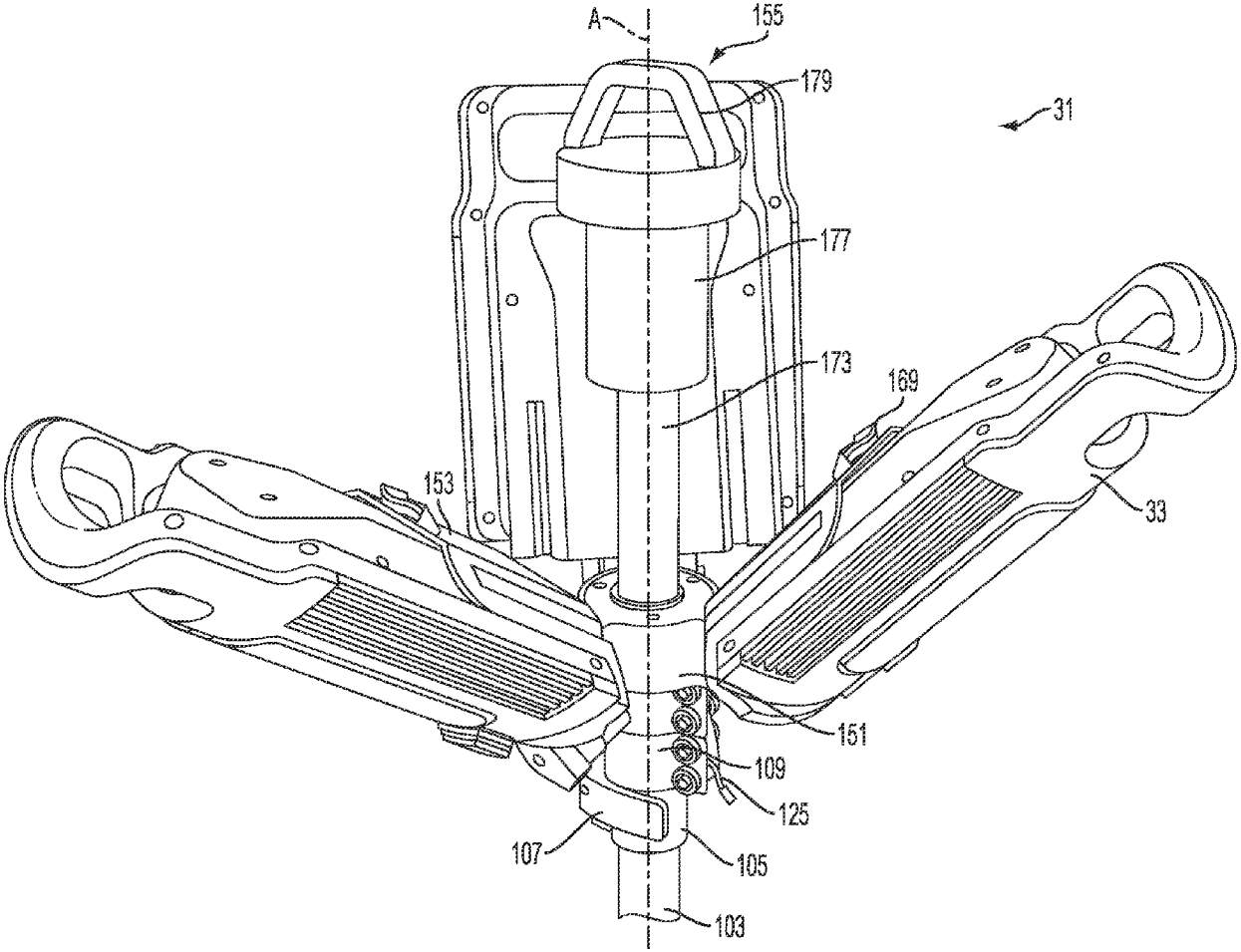
FIG. 8 is a side view of a light assembly section.
Figure 9:
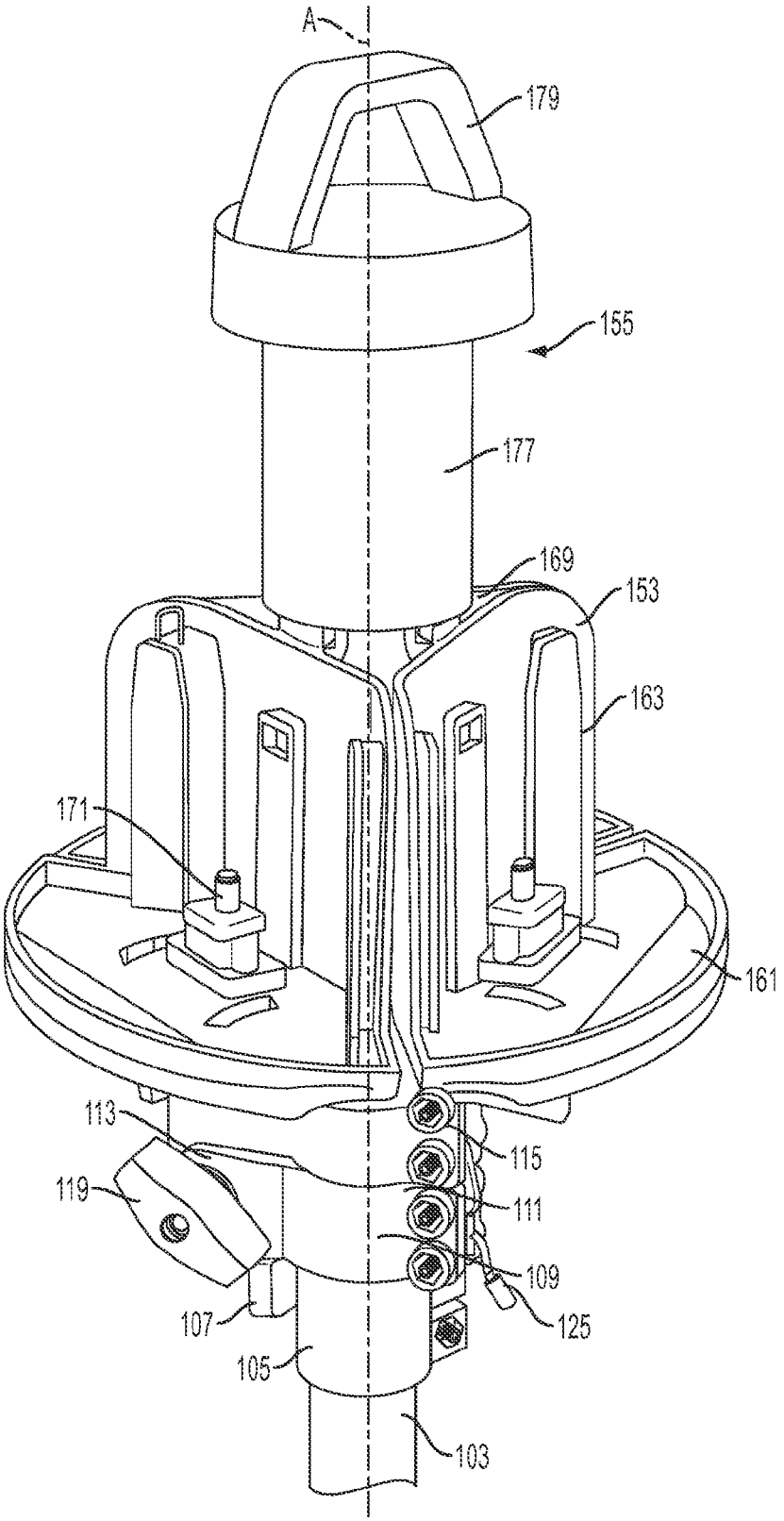
FIG. 9 is a perspective view of the light assembly section with light panels removed.

Referring now to FIGS. 2, 8, and 9, the light assembly section 31 may generally comprise a hinge bracket 151, at least one light panel holder 153, and a center lock assembly 155. The hinge bracket 151 may include at least one hinge arm 157 having a hinge shaft 159 received therethrough for tilting the light panel holders relative to the longitudinal axis A and the axis or support axis, further defined by the angle α, of the light assembly section 31.

The light panel holder 153 may generally comprises a tray portion 161 and a back portion 163. Hinge arms 165 may extend from a bottom surface of the tray portion 161. The hinge arms 165 may receive the hinge arm 157 and hinge shaft 159 therethrough so as to hingedly attach the light panel holder 153 to the hinge bracket 151. As illustrated at FIG. 8, for example, the light assembly section 31 may include three light panel holders 153. The three light panel holders 153 may each face approximately 120° from each other in order to have approximately 360° of light coverage. According to other embodiments, the light assembly section 31 may be provided with two light panel holders or more than three light panel holders spaced at equal angles from each other. For example, four light panel holders may be provided each facing approximately 90° from each other.

Figure 10:
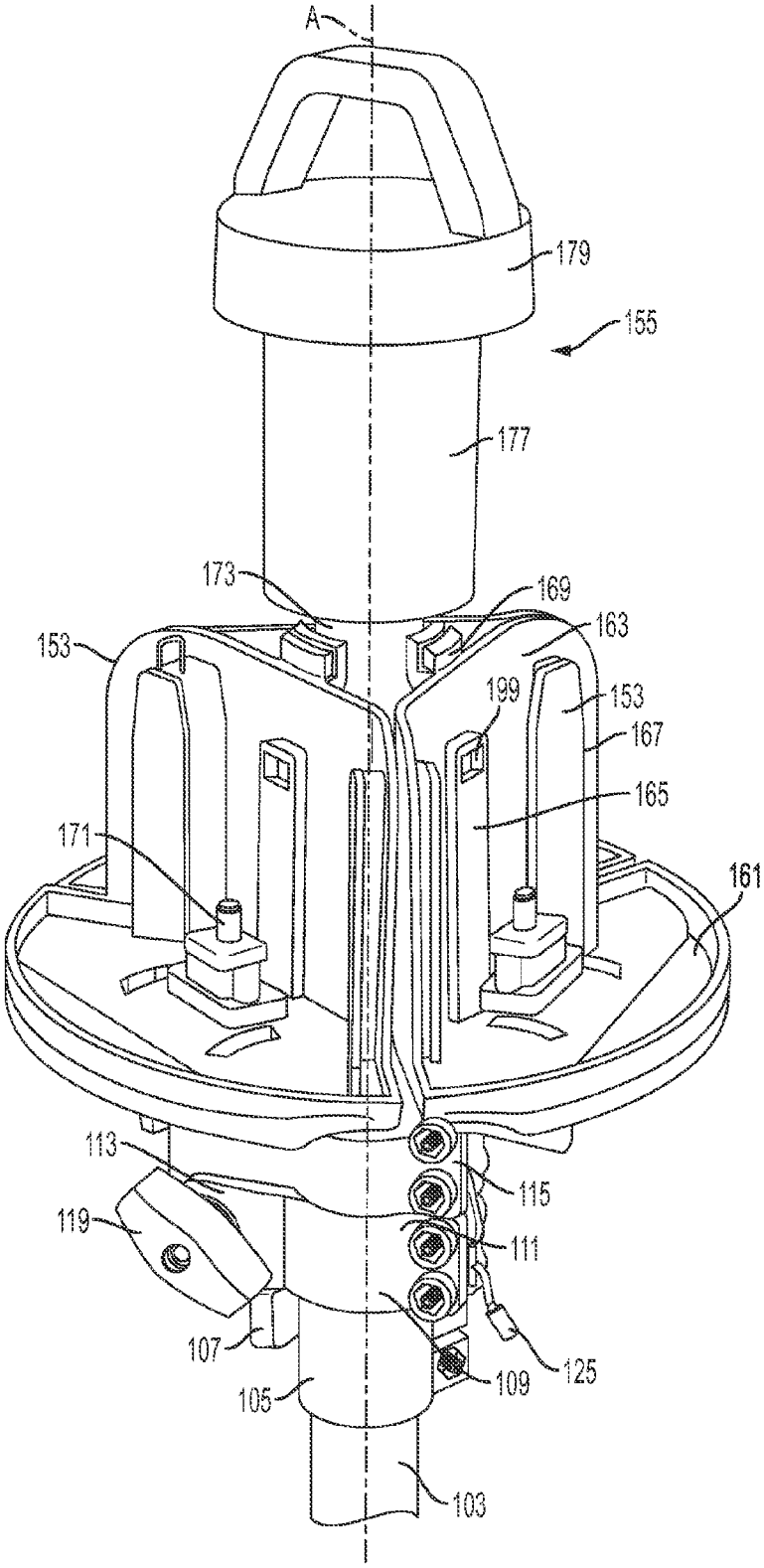
FIG. 10 is a perspective view of the light assembly section with light panels removed.
Figure 11:
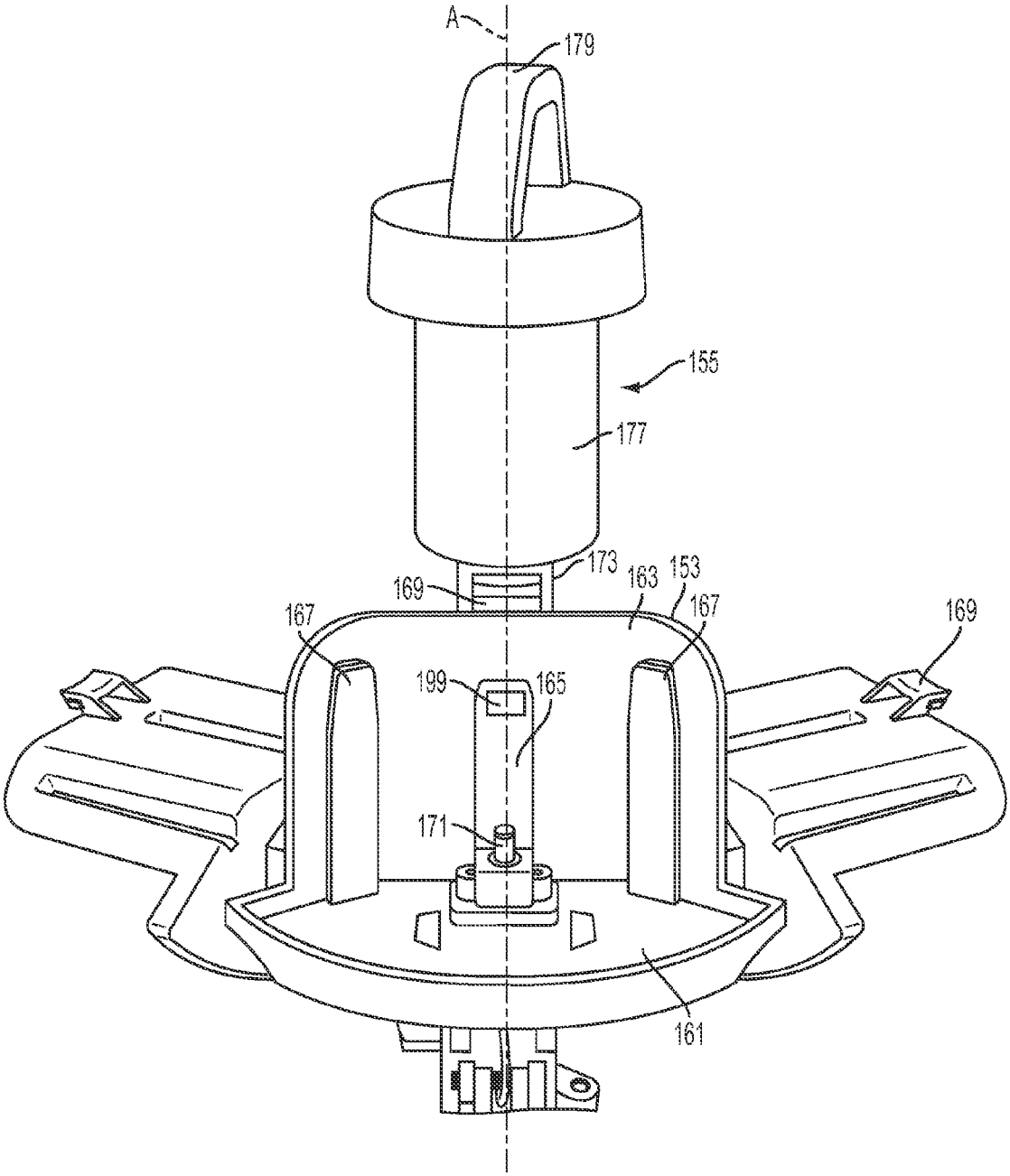
FIG. 11 is a front view of a light holder.

Referring now to FIGS. 9-11, the back portion 163 of the light panel holder 153 may include an alignment member 165 extending outwardly therefrom. The back portion 163 may additionally include at least one additional alignment member 167 extending outwardly therefrom. Further, a tilt lock portion 169 may extend from the back portion 163 of the light panel holder 153. A power source connector 171 may also be provided at the light panel holder. As explained in further detail, the alignment groove 165 and/or 167 may help to align the light panel 33 to be plugged into the power source 171.

Referring now to FIGS. 2, 9, 10, and 12, an upper post 173 may extend upwardly from the upper shaft bracket 115 of the tilting hinge 109 and through the hinge bracket 151. As shown at FIG. 2, a center lock bracket 175 may be provided on the end of the upper post 173. A center lock member 177 having a handle 179 thereon is disposed over the center lock bracket 175. The center lock bracket 175 is provided with a partially circumferential groove or protrusion 181 on the outer surface thereof. The center lock member 177 may be provided with a protrusion 183 extending inwardly from an inner surface thereof. The protrusion 183 of the center lock member 177 may interact with the groove or protrusion 181 of the center lock bracket 175 such that when the protrusion 183 is captured under the protrusion 181 to keep the center lock member 177 in a downward or locked position, as illustrated at FIG. 9. The center lock member 177 may be upwardly biased such as, for example, spring 185. According to an embodiment, when the protrusion 183 is not captured under the protrusion 181, the center lock member 177 is urged to an upward or unlocked position, as shown at FIG. 10. According to yet other embodiments, it is foreseen that the center lock member 177 may be moved between the downward and upward positions by other means as know by one of ordinary skill in the art such as, for example, threaded connections.

Figure 12:
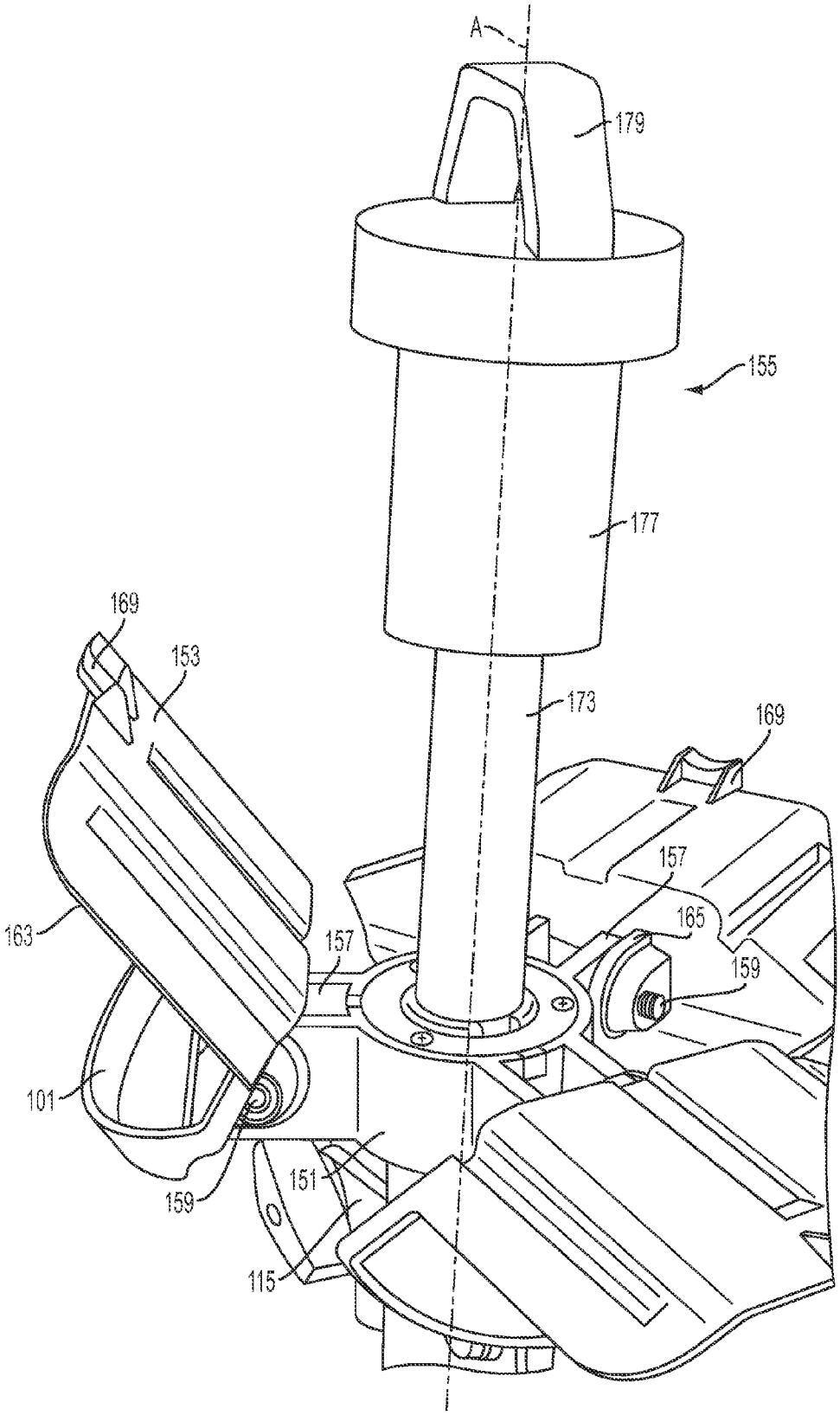
FIG. 12 is a side view of a light holder.
Figure 13:
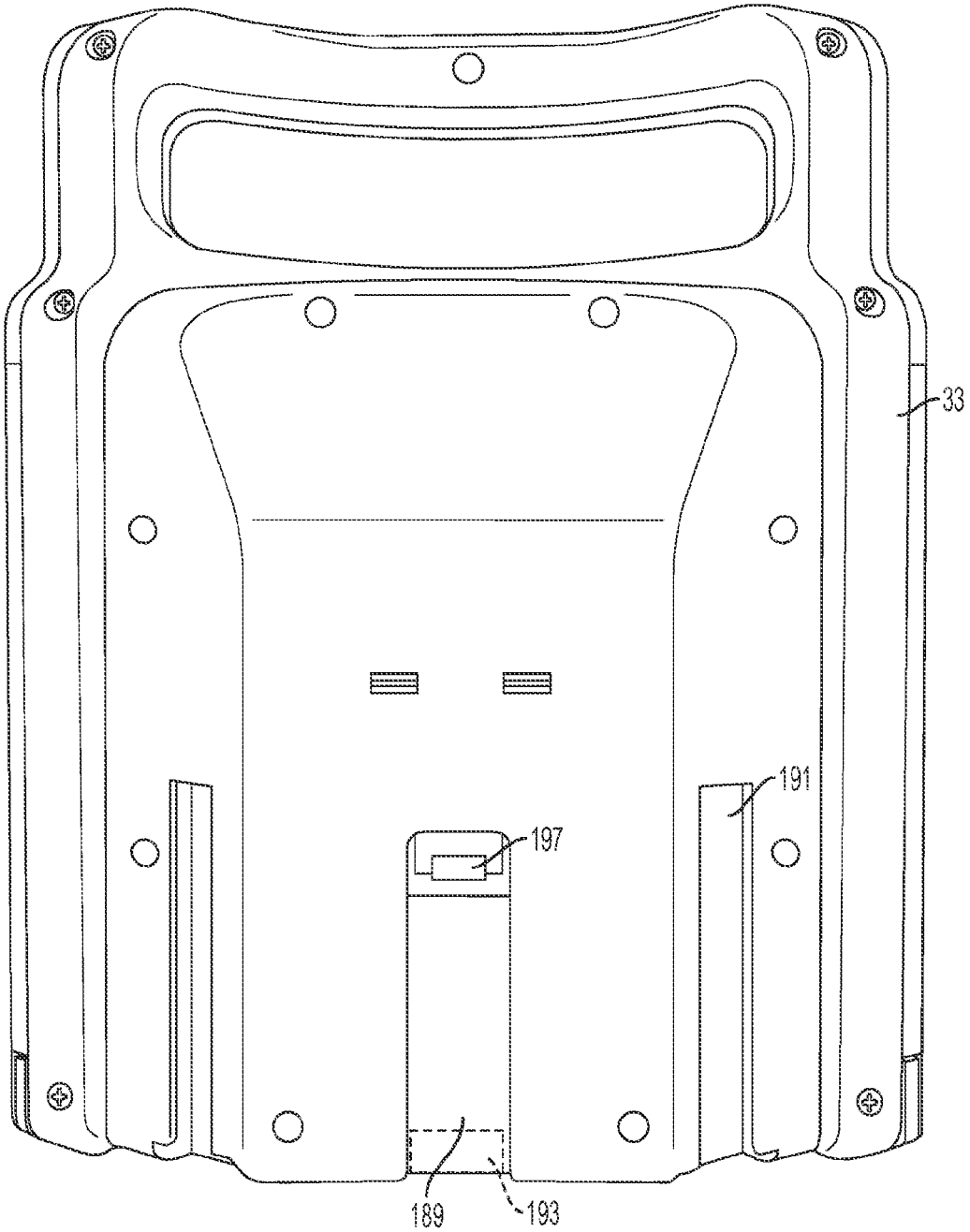
FIG. 13 is a rear view of the removable light.

Referring now to FIGS. 9 and 10, the light panel holder 153 may be tilted to an upright position, with the back portion 163 substantially parallel to the support axis defined by the angle α from the longitudinal axis A, such that the tilt lock portion 169 extending from the back portion 163 of the light panel holder 153 is within a circumference of the center lock member 177. Referring now to FIG. 9, when the center lock member 177 is in the downward or locked position, the center lock member 177 may be disposed over the tilt lock portion 169 thus preventing the light panel holder 153 from tilting. Referring now to FIG. 10, the center lock member 177 may be moved or urged to the upward or unlocked position thus allowing the light panel holder 153 to be tilted. For example, as shown at FIG. 12, the tilted light panel holder 153 may be considered a fifth use position. According to other embodiments, it is foreseen, that the tilt lock portion 169 may extend from other portions of the light panel holder 153 such as, for example, rearwardly from a back surface of the back portion 163.

Figure 14:
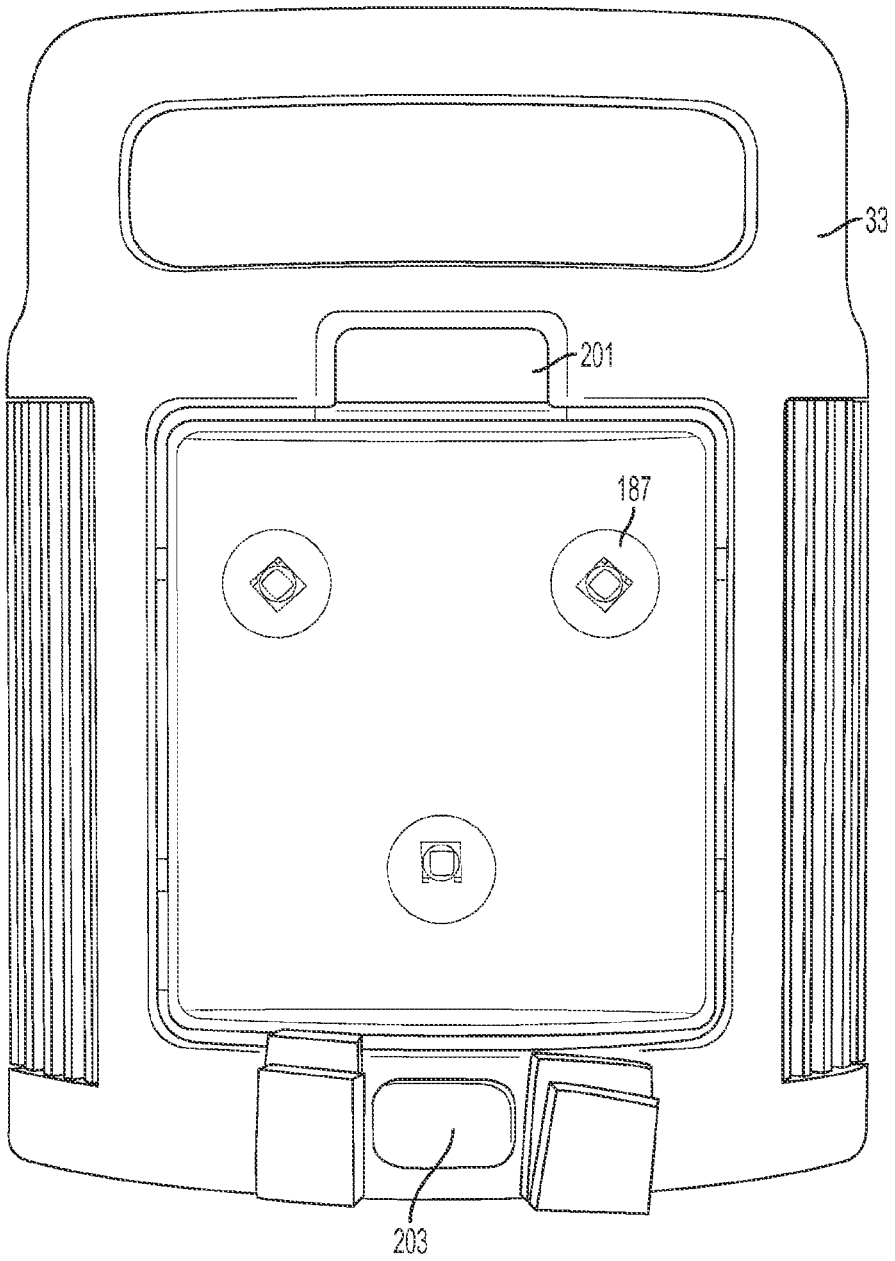
FIG. 14 is a front view of the removable light.
Figure 15:
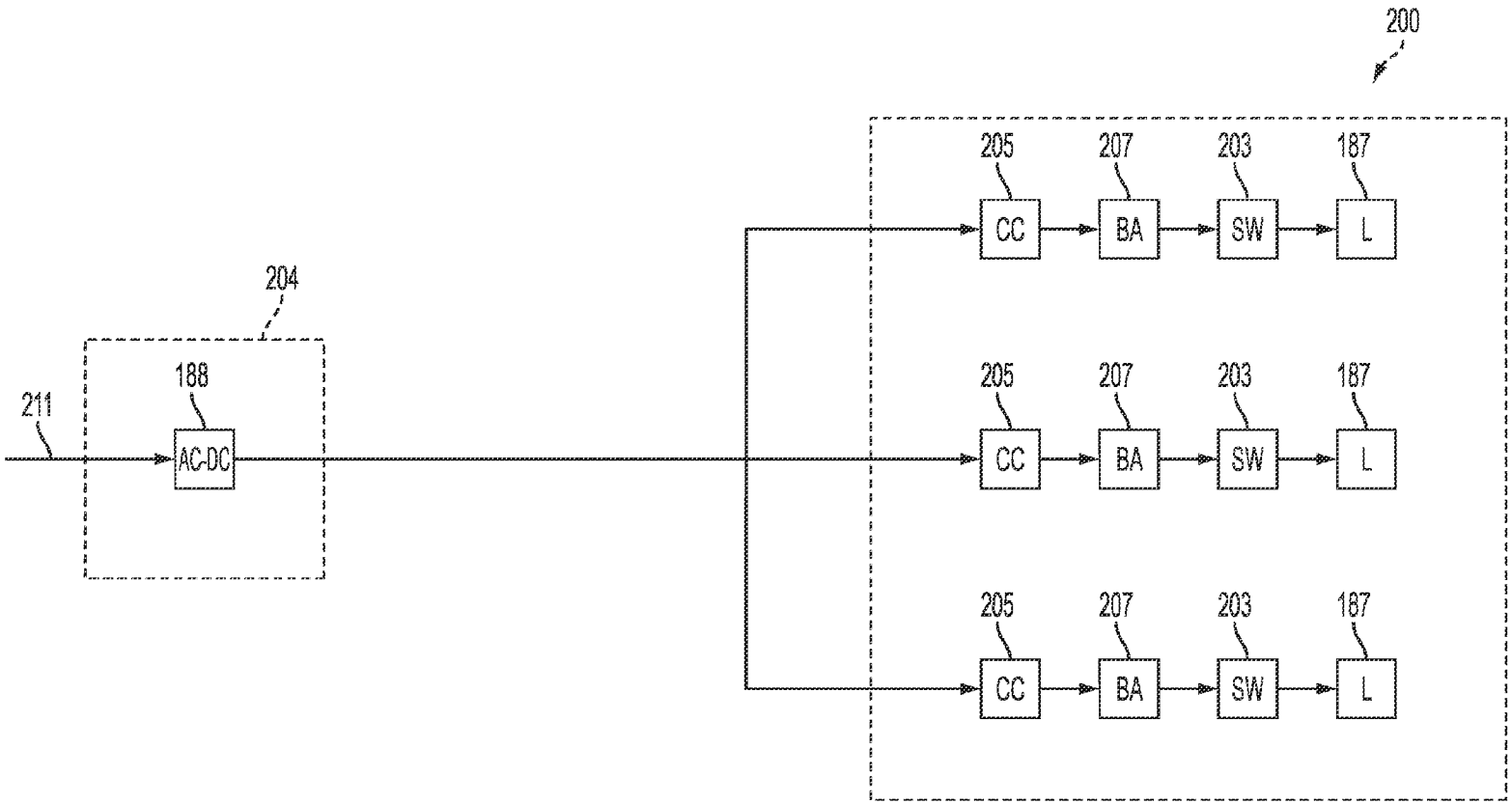
FIG. 15 is a circuit of an embodiment of a light panel.

Referring now to FIGS. 14 and 15, each light panel 33 includes a front having at least one light 187 therein, and a back having at least one groove 189 and 191 therein corresponding to each of the alignment members 165 and 167 of the light panel holder 153. The light panel 33 may further include a power connection 193 corresponding to the power source connection 171 of the light panel holder. According to an embodiment, the light panels 33 may further include a handle 195 extending therefrom. The light panel 33 may be removable from the light panel assembly 155, as illustrated, for example, at FIG. 9. The light panel assembly 155 receives the light panel 33 therein such that the alignment members 165 and 167 of the light panel holder 153 are slidably received in the grooves 189 and 191 of the light panel 33. When the light panel 33 is received in the light panel holder 153, the power connection 193 of the light panel 33 may be electrically connected to the power source connection 171 by receiving the power source connection 171 therein. The mating connections between the grooves and the members, described above, may help to properly align the light panel 33 in the light panel assembly.

The light panel 33 may be further provided with a latch 197 to latch the light panel 33 into the light panel holder 153. The latch 197 may be provided at an upper end of the alignment groove 189. For example, the latch 197 may be outwardly biased such that the latch 197 protrudes from the surface of the alignment groove 189. The light panel receiver 153 may include a corresponding latch receiver 199 at an upper end of alignment member 165, as shown at FIG. 11. When the light panel 33 is placed into and received by the light panel holder 153, the latch 197 may be biased outwardly into the latch receiver 199 such that the light panel 33 is latched in place into the light panel holder 153. In order to unlatch the light panel 33 from the light panel receiver 153, the light panel 33 may be provided with a button 201. The button 201 may be mechanically connected to the latch 197 such that when the button 201 is depressed, the latch 197 recedes to the surface of the alignment groove 189. Accordingly, when the button 201 is depressed, the light panel 33 may be unlatched from the light panel holder 153 and the light panel 33 may be removed. According to other embodiments, other latch mechanisms may be used. For example, the latch may be electrically actuated or may be an electromagnetic latch.

According to an aspect of an embodiment, the tilting of the light panel holder 153 may be fixed by the center lock member 177, as explained above, independent of the latching of the light panel 33 in the light panel holder 153. For example, the light panel holder 153 may tilt while the light panel 33 is latched in the light panel holder 153. Alternatively, the light panel holder 153 may be fixed by the center lock member 177 while a user may unlatch and remove the light panel 33 from the light panel holder 153.

Thus, a light stand 1 is described that is adjustable on multiple axes. For example, the height and the rotation of the light assembly section 31 may be adjusted with the telescoping section 121, as described above. Further, a tilting angle of the entire light assembly section 31 may be adjusted. Still further, a tilting angle of each light panel 33 may be adjusted independent from the tilting angle of the entire light assembly section 31. Accordingly, the light stand may be configured to be a variety of different use-positions and various combinations thereof.

Various embodiments of an electrical circuit 200 may be used in combination with the embodiments described herein and illustrated at FIGS. 15-19. The electrical circuit 200 may be contained within each light panel 33 or within the light assembly section 31 or within both of the light panels 33 and light assembly section 31. In order to provide power to the light stand 1, the light stand 1 may include an electrical connection, such as via electrical cord 202 illustrated at FIGS. 1 and 2, to an alternating current (AC) external power supply 211. The light stand may further include an AC-DC adapter 188 in a portion 204 of the light stand 1 in order to provide direct current power to the electrical circuit. Alternatively, an external battery (not shown) may be the external power source or an internal battery 186 external to the light panel 33 but otherwise contained within the light stand 1, for example, within lower holder 53, center post 59, or upper lock collar 55, may be used, as illustrated, at FIG. 2. The internal battery 186 may be further provided with a charging circuit 205, as described below.

Each light panel 33 may be provided with a light 187, a battery 207, with a circuit to supply a driving current to the light 187. According to an embodiment, the light 187 may be a light emitting diode, an incandescent light, a halogen light, or any type of light as known to one of ordinary skill in the art. It is foreseen that only one light or any plurality of lights may be provided in each light panel 33. Each light panel 33 may be further provided with a power switch 203 to actuate power to the light 187. For example, when the electrical power circuit is not connected to the external power source or when the light panel 33 is removed from the light panel holder, the power switch is configured to provide power from the battery 207 internal to each light panel 33 in order to actuate the light 187 in the light panel 33 between the OFF and ON position The circuit may be configured to power the circuit of the light panel 33 when the power connection 193 of the light panel 33 is electrically connected with the power source connection 171 of the light panel holder 153. As described above, such an electrical connection may be provided when the light panel 33 is received in the light panel holder 153.

Referring now to FIG. 15, when the circuit of the light panel is powered by the external power source, the circuit may be configured to charge the battery 207 of the light panel 33 with a charging circuit 205. Accordingly, when the light panel 33 is removed from the light panel holder 153, the circuit may be powered from the light panel internal battery 207 in order to provide the driving current to the light 187. When the light panel 33 is received in the light panel holder 153 and an electrical connection is established, the circuit may provide power to charge the battery 207 of the light panel 33 while simultaneously drawing power from the battery 207 in order to provide the driving current to the light 187, as illustrated at FIG. 15. In such an embodiment, the driving current provided to the light 187 is provided through the circuit from only the battery 207.

Figure 16:
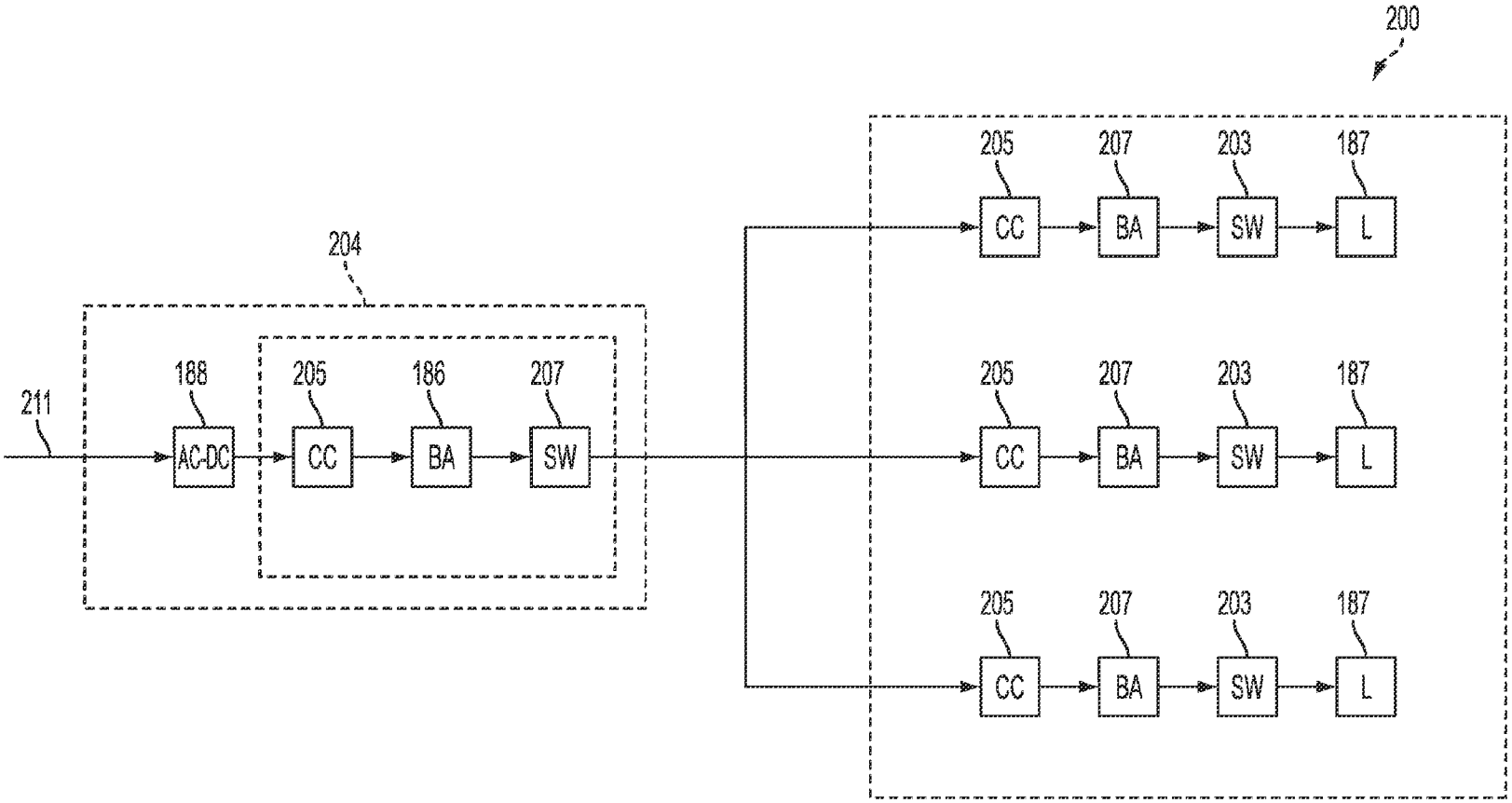
FIG. 16 is a circuit of an embodiment of a light panel.

Referring now to FIG. 16, the embodiment of FIG. 15 may be modified to include the central battery 186 with a charging circuit 205. As explained above, the central battery 186 and charging circuit 205 may be contained within the stand section 11 or telescoping section 21 of the light stand 1. A switch 209 located on the light stand 1 may be further included to switch power ON or OFF from the central battery 186 or external power supply.

Figure 17:
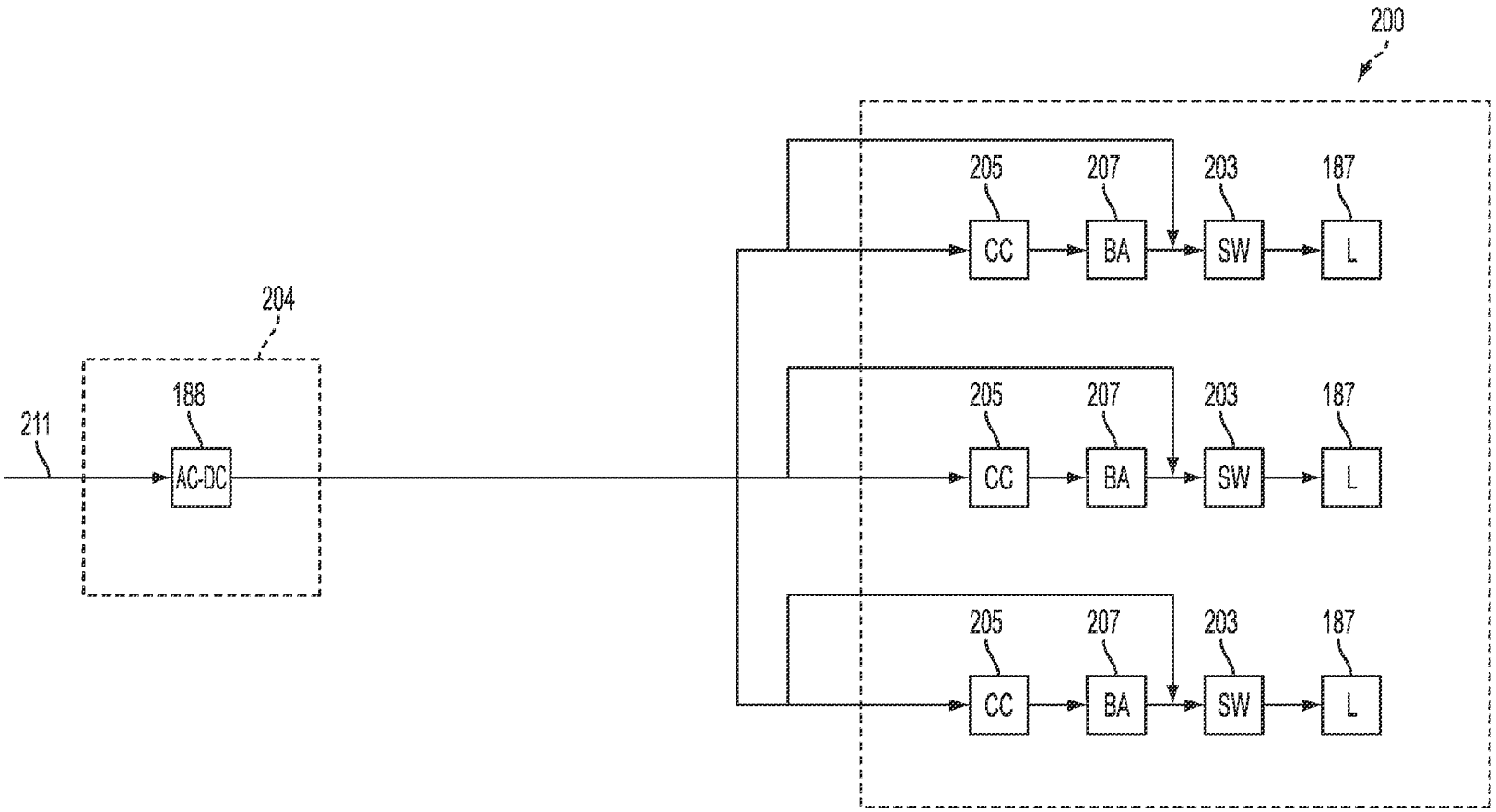
FIG. 17 is a circuit of an embodiment of a light panel.

Referring now to FIG. 17, when the light panel 33 is received in the light panel holder 153 and an electrical connection is established, the circuit may provide power to charge the battery 207 of the light panel 33 and provide the driving current to the light 187 directly from the external power supply. In such an embodiment, the battery 207 is not used to provide the driving current to the light 187 when the light panel 33 is received in the light panel holder 153 and an electrical connection is established. When the light panel 33 is removed from the light panel holder 153, the circuit may switch the power source providing driving current to the light 187 from the external power source to the battery 207 internal to the light panel 33. Similarly, when the light panel 33 is placed in the light panel holder 153, the circuit may switch the power source providing driving current to the light 187 from the battery 207 internal to the light panel 33 to the external power source.

Figure 18:
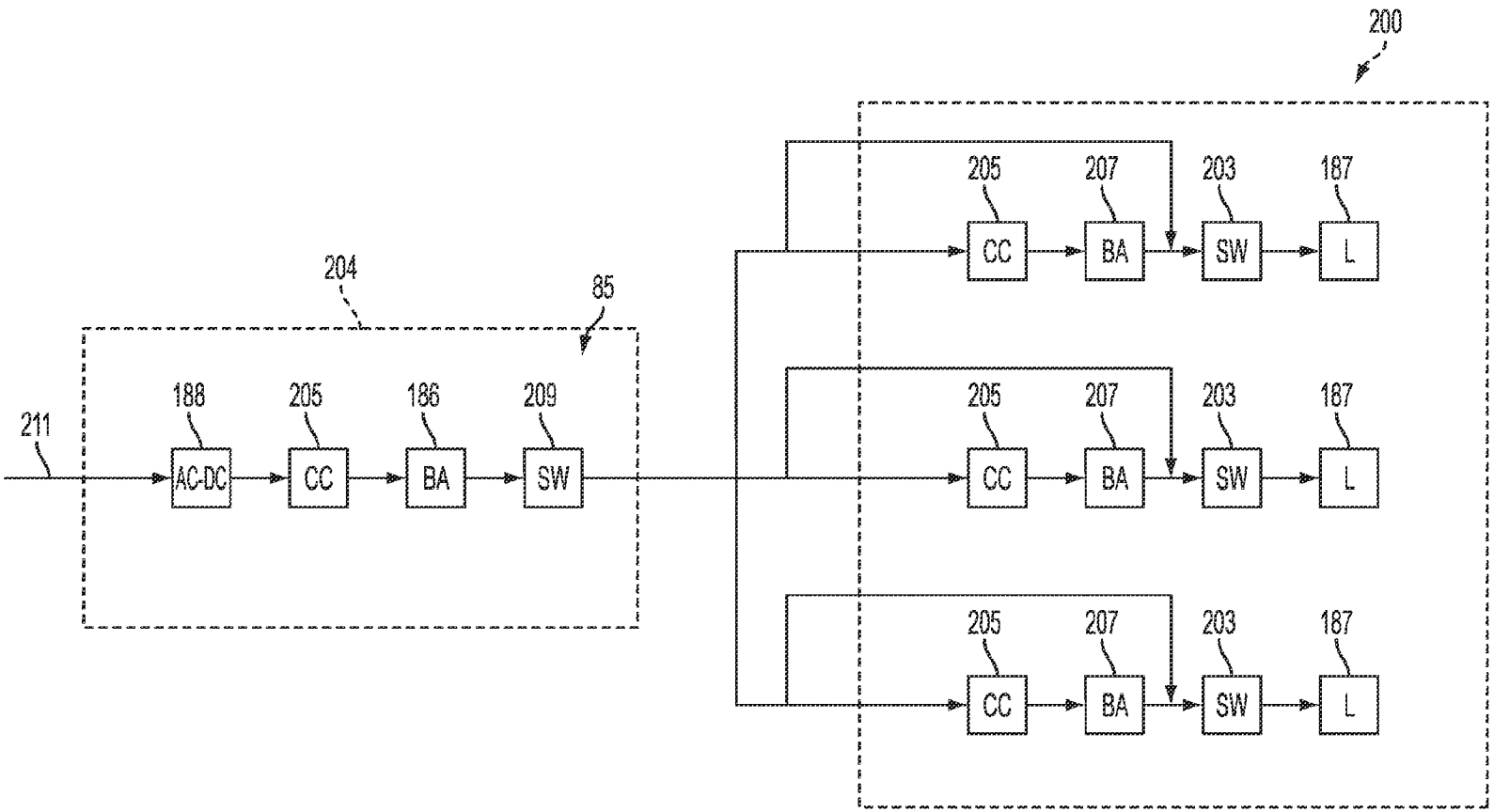
FIG. 18 is a circuit of an embodiment of a light panel.
Figure 19:
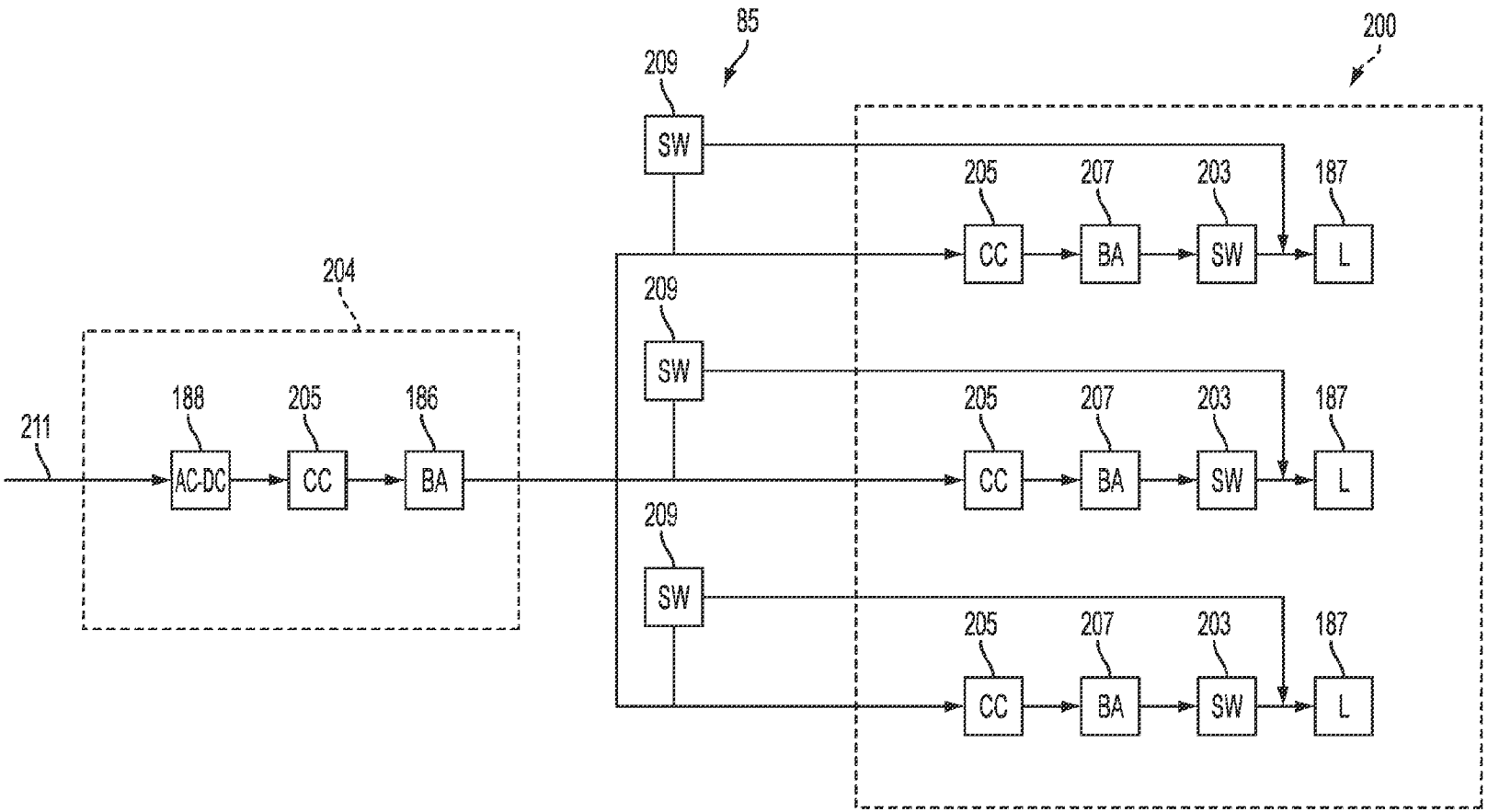
FIG. 19 is a circuit of an embodiment of a light panel.

Referring now to FIGS. 18 and 19, the control panel 85 located in or on a portion 204 of the light stand 1 may be used to switch power one or more switches 209 from the external power source to a light panel 33 or to any of a plurality of light panels 33. When the switch 209 is switched to provide power to any one of the light panels 33, the circuit may be provided as described above. Accordingly to an embodiment, the control panel 85 may be a master switch 209 to switch power on/off to the light assembly section 31. Referring now to FIG. 19, a plurality of switches 209 may be located remotely from the light stand 1 and may be provided to switch power to each of the plurality of light panels 33 independently. Alternatively, the plurality of switches 209 may be located in or on a portion 204 of the light stand 1. For example, the switches 209 may be configured to provide a driving current to the lights 187. Alternatively, each of the switches 209 may be provided in series with the charging circuits 205.

According to another embodiment, the control panel 85 may be further provided with a central battery 186 such as the battery provided external to the light panel 33 but otherwise contained within the light stand 1. The central battery 186, or battery located centrally with the light stand 1, may provide power to the circuit described above. The central battery may further include a charging circuit 205 connected to the external power source such as through adapter 188.

The various electrical connections may be provided with electrical cables or wiring provided through the base 51, the center post 59, and the first and second telescoping shafts 101 and 102 to provide power from the external power source to the light assembly section 31 and light panel holders 153. As shown at FIG. 7, for example, the cables or wiring may be provided through a center cavity of the light stand 1. As described above, the electrical cables or wiring may be used to connect the external power source to the control panel 85 and to the power source connection 171.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

I claim:

1. A portable light, comprising:

a light stand having a longitudinal axis; and a light assembly section hingedly attached to the light stand, wherein the light assembly section is adapted to be connected to a power source and comprises:

a support having a support axis, wherein the support is rotatable and linearly displaceable relative to the longitudinal axis of the light stand;

at least one light panel holder tiltably attached to the support, wherein the at least one light panel holder is tiltable between a stow position aligned essentially parallel to the support axis and a tilt position at an angle to the support axis; and a light panel removably connected to the light panel holder and tiltable relative to the support axis along with the light panel holder, the light panel containing a rechargeable battery and a light selectively electrically connectable to at least one of the power source and the rechargeable battery when the light panel is connected with the light panel holder and being powered by the rechargeable battery when the light panel is removed from the light panel holder, wherein the at least one light panel holder and the light assembly section are both tiltable independent of each other.

2. The portable light of claim 1, wherein the light assembly section further comprises a center lock member, wherein the center lock member is movable substantially along the support axis between an unlocked position and a locked position;

wherein the light panel holder further comprises a back portion and a tray portion, the back portion having a tilt lock portion extending therefrom;

wherein in the locked position, the center lock member captures the tilt lock portion to fix the at least one light panel holder in the stow position.

3. The portable light of claim 2, wherein the light panel is removable when the center lock member captures the tilt lock portion to fix the at least one light panel holder in the stow position.

4. The portable light of claim 1, further comprising a telescoping section, wherein the light assembly section is hingedly attached to the telescoping section of the light stand, wherein the light assembly section is tiltable between a tilted position and an upright position relative to the longitudinal axis of the light stand.

5. The portable light of claim 1, wherein the light panel assembly section further comprises an electrical power circuit configured to selectively connect the at least one of the power source and the rechargeable battery to the light.

6. The portable light of claim 5, further comprising a central control panel configured to selectively provide power from the external power source to the light panel in order to actuate a light in the light panel between an OFF and ON position.

7. The portable light of claim 6, wherein the light panel further comprises a light panel switch, wherein when the electrical power circuit is not connected to the external electrical power source or when the light panel is removed from the at least one light panel holder, the light panel switch is configured to provide power from the rechargeable battery in order to actuate the light in the light panel between the OFF and ON position.

8. The portable light of claim 1, wherein the light stand section includes a plurality of legs, wherein the plurality of legs are movable between a stow position and a standing position.

9. The portable light of claim 8, wherein when the plurality of legs are in the stow position and the at least one panel holder is in the stow position, the portable light forms a substantially cylindrical shape.

10. A portable light comprising:

a telescoping section having a lower telescoping member and an upper telescoping member, and a light assembly section comprising:

a tilting hinge disposed on the upper telescoping member, wherein the light assembly section is configured to tilt relative to the upper telescoping member;

at least one light panel holder configured to tilt relative to an axis of the light assembly section, the at least one hinged light panel holder having a tilt lock portion extending therefrom;

a center lock member movable along the axis of the light assembly section between an unlocked position and a locked position, wherein in the locked position the center lock member is configured to capture the tilt lock portion to prevent tilting of the at least one light panel holder; and a light panel disposed on the at least one light panel holder.

11. The portable light of claim 10, wherein the light panel is removable from the at least one light panel holder.

12. The portable light of claim 11, wherein the light panel further comprises a latch, and the at least one light panel holder further comprises a latch receiver configured to receive the latch.

13. The portable light of claim 11, wherein the light assembly section further comprises an electrical power circuit connectable to an external power source and configured to provide power to the light assembly section.

14. The portable light of claim 13, wherein when the light panel is disposed on the at least one light panel holder, the electrical power circuit is configured to provide power to the light panel.

15. The portable light of claim 14, wherein when the light panel is disposed on the at least one light panel holder, the electrical power circuit is configured to provide power to a battery contained within the light panel.

16. The portable light of claim 15, wherein when the light panel is disposed on the at least one light panel holder, the electrical power circuit is configured to charge the battery.

17. The portable light of claim 15, wherein when the light panel is disposed on the at least one light panel holder, the electrical power circuit is configured to provide a driving current to the light panel.

18. The portable light of claim 10, further comprising a stand section having a plurality of legs, wherein the plurality of legs are movable between a stow position and a standing position.

19. The portable light of claim 18, wherein when the plurality of legs are in the stow position, the portable light forms a substantially cylindrical shape.

* * * * *